US005794293A

United States Patent [19]

Hoffinger

[11] Patent Number: 5,794,293

[45] Date of Patent: Aug. 18, 1998

[54] POOL SWEEP CLEANER

[76] Inventor: Martin I. Hoffinger, 2239 Embassy Dr., West Palm Beach, Fla. 33401

[21] Appl. No.: 723,135

[22] Filed: Sep. 30, 1996

[51] Int. Cl.[6] ..... E04H 4/16

[52] U.S. Cl. ..... 15/1.7

[58] Field of Search ..... 15/1.7

[56] References Cited

U.S. PATENT DOCUMENTS

| | | | |
|---|---|---|---|
| 4,023,227 | 5/1977 | Chauvier | 15/1.7 |
| 4,133,068 | 1/1979 | Hofmann | 15/1.7 |
| 4,193,156 | 3/1980 | Chauvier | 15/1.7 |
| 5,014,382 | 5/1991 | Kallenbach | 15/1.7 |
| 5,404,607 | 4/1995 | Sebor | 15/1.7 |
| 5,655,246 | 8/1997 | Chang | 15/1.7 |

FOREIGN PATENT DOCUMENTS

| | | | |
|---|---|---|---|
| 559477 | 9/1993 | European Pat. Off. | 15/1.7 |

*Primary Examiner*—Mark Spisich
*Attorney, Agent, or Firm*—Knobbe, Martens, Olson & Bear, LLP

[57] ABSTRACT

A pool sweep device comprised of two suction tubes that are attachable to a single suction pump. The suction pump preferably consists of a suction pump that is part of the pool's filtration system. The two suction tubes both define openings in a central plenum and the central plenum is in communication with a water intake opening or orifice. Water is sucked through the intake opening and the device is configured so that the intake opening is maintained in contact with the inner surfaces of the pool so that particulate matter resting on the inner surfaces of the pool can be sucked through the opening, the plenum and one of the suction tubes into the hose that is attached to the pool's suction pump. Positioned within the plenum is a wedge that moves between the two openings so as to alternatively cover one of the two openings. When an opening is covered, a suction force is exerted against the wedge which results in mechanical movement of the device over the inner surfaces of the pool. Further, water containing particulate matter is then sucked through the other opening which gradually reduces the suction exerted against the wedge on the first opening. Ultimately the wedge is released from the first opening and then is induced to cover the second opening which results in mechanical movement of the device. Hence, the pool sweep device travels over the bottom surface of the pool as a result of the wedge cycling between the two openings and sealing the openings.

3 Claims, 5 Drawing Sheets

POOL SWEEP CLEANER

BACKGROUND OF THE INVENTION

1. Field of the Invention

The present invention relates to pool cleaning equipment and, in particular, concerns a suction pool sweep apparatus.

2. Description of the Related Art

As anyone who is acquainted with the tedious task of cleaning a pool knows, pools collect a significant amount of debris and dirt. The debris and dirt is the result of swimmers carrying the debris and dirt with them as they enter the pool or is the result of airborne particles blowing into the pool. In order to maintain a clean pool, this material must be periodically removed. At one time, this material was removed entirely by hand using brushes and skimmers and the like. However, this method of cleaning a pool was, of course, time consuming and tedious.

To address this particular problem, other pool cleaners were developed. In particular, pools were equipped with filtration systems that would filter the water out of the pool. Essentially, a filtration system sucks water out of the pool at various ports and then runs this water through a filter. Waterborne particles are then trapped by the filter so that only clean water is recirculated back into the pool. The intake vent for the filtration system is preferably located at a place where more heavy particulates are likely to be positioned. While filtration systems are effective at removing the lighter waterborne particles, it will be appreciated that larger and heavier and particles of dirt and debris, such as rocks and twigs, and the like, are unlikely to be removed by the filtration system.

To address this particular problem, mobile pool cleaners have been developed that will move along the bottom of the pool and suck dirt and debris off the bottom of the pool. One very common configuration of pool sweep cleaner comprises a wheeled carriage which travels along the bottom of the pool as the result of water pressure that is supplied to the carriage via a hose. The carriage has a movable oscillating tail which extends beyond the carriage and projects water out of the tail in a random fashion to randomly propel the carriage along the bottom surface and sidewalls of the pool. The carriage is also equipped with a suction intake and a debris capture bag wherein the suction intake sucks debris from underneath the pool sweep cleaner into the debris capture bag. While these types of devices are effective in removing larger particulates of debris from the bottom of a pool, these types of devices do suffer from some disadvantages.

In particular, these types of pool cleaners require a separate source of pressurized water to be supplied to the cleaner. Further, these devices are more complicated and are, therefore, more expensive and are also more inclined to break down.

Other types of pool cleaners that are used with the pool filtration system have also been developed. Typically, these types of pool cleaners have hoses which extend from the filtration pump of the pool into the pool cleaner that rests on the bottom surface of the pool. Water is then pumped from the pool through the suction pool sweep cleaner into the filtration system. Preferably, the suction pool sweep cleaner randomly travels over the bottom surface of the pool in response to the suction from the filtration system so as to travel over substantially the entire area of the pool and remove debris positioned thereon. While these types of devices are generally less expensive and more reliable than the water propelled pool sweep cleaners, these types of devices oftentimes are somewhat immobile. Consequently, these types of devices travel along the bottom of the pool at a relatively slow rate and are, therefore, a little less effective in cleaning the bottom surface of the pool. Further, devices that are currently used, are also inclined to get stuck at corners in the pool thereby rendering the device ineffective.

Hence, there is a need for a pool sweep cleaner that is inexpensive to install and is reliable in operation. To this end, there is a need for a pool sweep cleaner that is suction powered via the suction pump used in conjunction with a pool's filtration system wherein the pool sweep cleaner is configured to be readily movable along the bottom surface of the pool in a random fashion. This pool sweep cleaner should also be designed so as to be able to climb sidewalls and the like without significantly impairing the function of the pool sweep cleaner.

SUMMARY OF THE INVENTION

The aforementioned needs are satisfied by the pool sweep cleaner of the present invention which is essentially comprised of an intake orifice that is configured to be slidably engaged with the bottom side of the pool, wherein the intake orifice is connected to one of two suction pipes positioned within a body of the pool sweep cleaner. The suction pipes are connected to a single central suction hose that is configured to be connected to a pump that is part of the pool filtration system. The two suction pipes have angled openings that are in communication with the intake orifice and there is a triangular wedge which is positioned between the two intakes of the suction pipe so as to be pivotably movable between the two intake openings.

In operation, a suction is created through the suction hose so as to suck water into the intake orifice through one of the two suction pipes. This suction of water results in the triangular wedge being urged towards the angled opening of the suction pipe. Preferably, the wedge is made of a deformable material that can be fully attracted to the intake opening so as to seal the intake opening in response to the applied suction. It will be appreciated that this results in water being sucked through the opposite suction pipe. However, prior to a full flow of water being sucked through the opposite suction pipe, the force of suction against the wedge results in physical movement of the pool sweep cleaner across the bottom surface of the pool. As the suction in the opposite pipe begins to build, the suction forces exerted against the wedge on the first pipe are lessened and the flow of water through the opposite pipe results in the wedge moving to the intake opening of the opposite pipe. Consequently, the wedge moves between the two intake openings so as to alternatively seal the openings which results in random movement of the suction pump pool sweep cleaner over the bottom surface of the pool.

In the preferred embodiment, the intake orifice is comprised of a narrow ledge of material so as to better form a seal between the lip of the inlet to the pipes and the deformable wedge. This results in better movement of the pool sweep suction cleaner of the preferred embodiment.

In another aspect of the invention, the pool sweep cleaner includes a weight that is mounted on an arm so as to extend outward from the intake orifice. Further, the arm is also angled so that the weight is positioned in a plane above a plane defined by the intake orifice. The angled arm facilitates movement of the suction pool sweep cleaner device over obstructions positioned in the pool and also facilitates rotational movement of the pool sweep cleaner about an axis perpendicular to the plane of the intake orifice when the pool sweep has traveled up the sidewall with a portion of the pool sweep extending out of the water. This rotational movement inhibits the pool sweep cleaner from toppling into the pool with the intake orifice disengaged from the wall.

Hence, the pool sweep cleaner of the preferred embodiment is simple in construction and operation and is also configured to be able to randomly move across the pools and up the sidewalls of the pool in a random fashion to adequately clean dirt and debris from the inner surfaces of the pool. These and other objects and advantages of the present invention will become more fully apparent from the following description taken in conjunction with the accompanying drawings.

DETAILED DESCRIPTION OF THE PREFERRED EMBODIMENT

Figure 1:
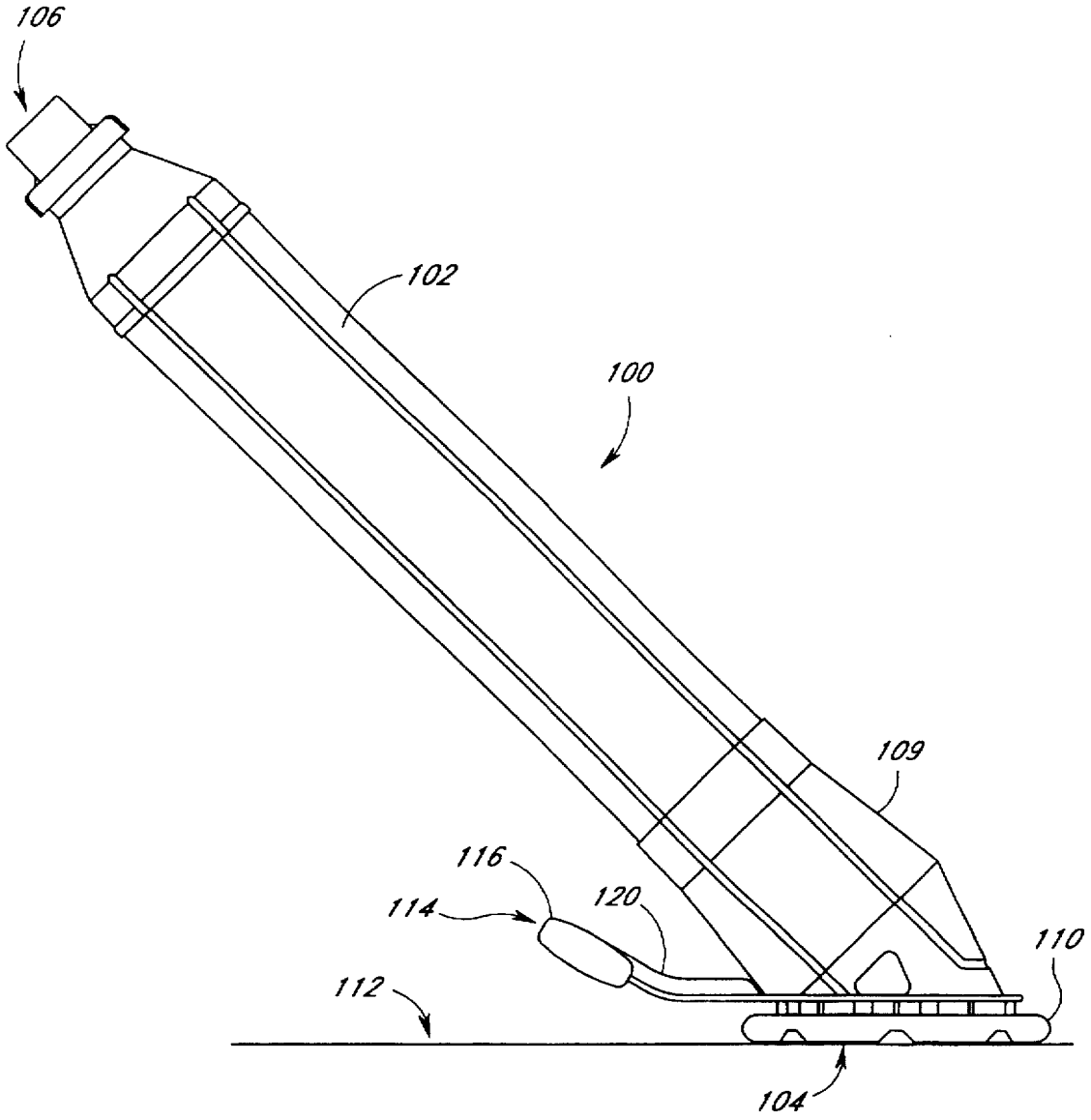
FIG. 1 is a side elevational view of a pool sweep cleaner device of the preferred embodiment.

Reference will now be made to the drawings wherein like numerals refer to like parts throughout. FIG. 1 illustrates a preferred embodiment of a pool sweep device 100. The pool sweep device 100 includes a canister 102 that contains two suction tubes that are described in greater detail hereinbelow. The upper end of the canister 106 is attached to a hose that is connected to a pump that forms a part of the pool's filtration system so that water can be sucked out of the pool through the device 100. At a bottom end 104 of the device, there is a water intake orifice that sucks water and dirt and debris from the inner surfaces of the pool.

In particular, the pool sweep device 100 is designed to randomly travel over the inner surfaces, i.e., the bottom surface and sidewall surfaces of the pool, continuously sucking water and dirt and debris positioned on these inner surfaces off of the surfaces and into the pool's filtration system. In this manner, the particulate debris and other types of debris, such as algae, that is positioned or otherwise adhered to the inner surfaces of the pool, can be removed.

As shown in FIG. 1, the inlet orifice end 104 of the device 100 includes a pad 110 that is in contact with an inner surface 112 of the pool. Preferably, the vacuum force from the vacuum pump results in continuous engagement of the pad 110 with the inner surface 112 of the pool. The exact configuration of the pad 112 will be described in greater detail in reference to FIGS. 4 and 5. The canister 102 is preferably constructed of lightweight plastic so that the device 100 can be maintained in the orientation shown in FIG. 1 wherein the bottom surface of the pad 110 is continuously retained in contact with the inner surface 112 as the pool sweep device 100 moves across the inner surfaces of the pool. FIG. 1 also illustrates that the device 100 of the preferred embodiment also includes a weight assembly 114 which is comprised of a weight 116 and an arm 120 that connects the weight 116 to the main body 102 of the device 100. As shown in FIG. 1, the arm 120 is preferably bent so that the weight is positioned in a plane above the plane defined by the interface between the pad 110 and the inner surface of the pool 112. As will be described in greater detail below, the purpose of the weight 116 is to facilitate rotational movement of the device 100 as the device 100 is traveling up a sidewall and the arm 120 is bent in the manner shown in FIG. 1 so as to facilitate movement of the device 100 over obstructions that extend perpendicularly outward from the inner surfaces 112 of the pool.

Figure 2:
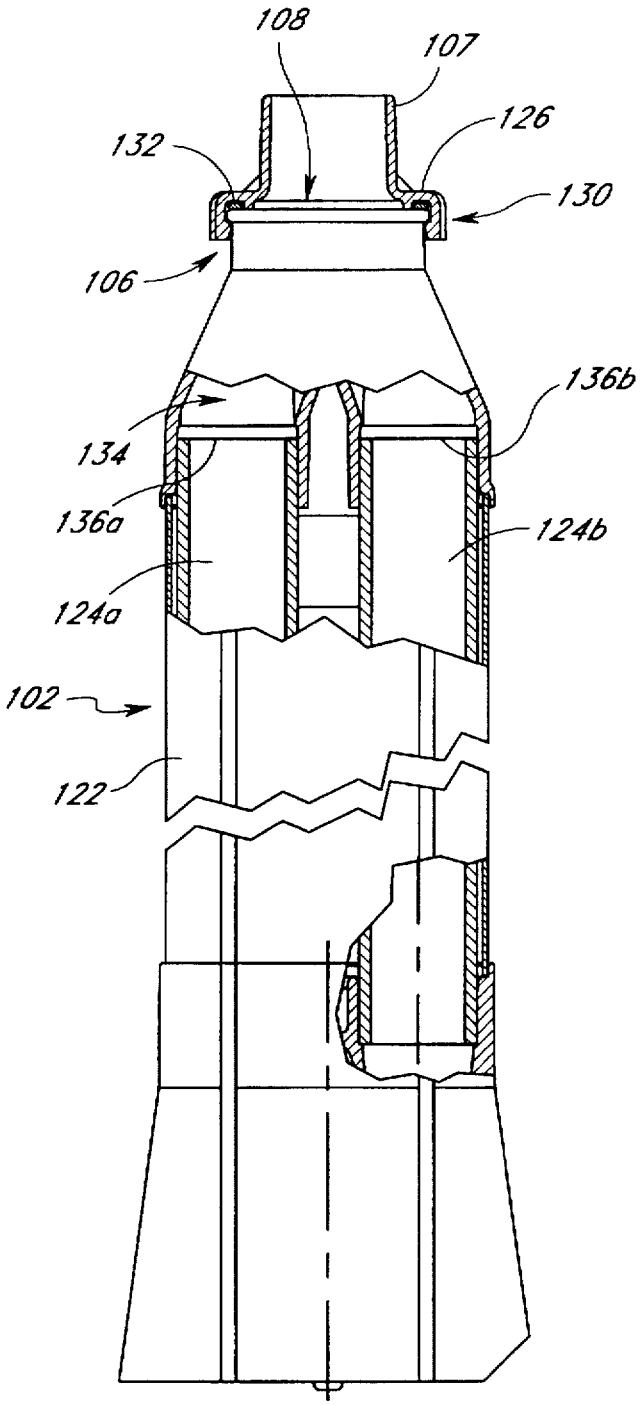
FIG. 2 is a top elevational view of a canister section of the vacuum pool sweep assembly of FIG. 1 that is partially broken away to show two vacuum tubes positioned therein.

FIG. 2 illustrates the canister section 102 of the device 100 in greater detail. In particular, the outer walls 122 of the canister 102 of the device 100 is partially broken away to illustrate two vacuum pipes 124 positioned within the canister section 102. The purpose of these vacuum pipes 124 will be described in greater detail in reference to FIG. 3 hereinbelow.

FIG. 2 also illustrates that the upper end 106 of the canister 102 defines a raised annular lip 126 which allows for a collar 130 attached to the end of the hose to be positioned thereover to securely retain the hose 107 on the upper end 106 of the canister 102. Preferably, a lubricated gasket 132 is interposed between the collar 130 and the annular lip 126 so that the canister 102 can freely rotate with respect to the hose 107. In the preferred embodiment, the lubricating gasket 132 is comprised of a gasket made of a lubricating plastic material. FIG. 2 illustrates that a single hose 107 is connected to the upper end 106 of the device 100. However, there are two vacuum pipes 124 positioned within the canister 102. At the upper end 106 of the canister 102, the two pipes 124 enter into a Y-shaped coupling 134 that has two inlets **136*a* and 136*b* respectively connected to the pipes 124*a* and 124*b* and a third inlet (not shown) that is connected to the orifice defined by the upper end 106 of the canister. Hence, when the pump in the pool filtration system exerts a vacuum against the hose 107, the vacuum is communicated through the upper end 106 of the canister 102 to one of either of the pipes 124** in a manner that will be described in greater detail hereinbelow.

Figure 3A:
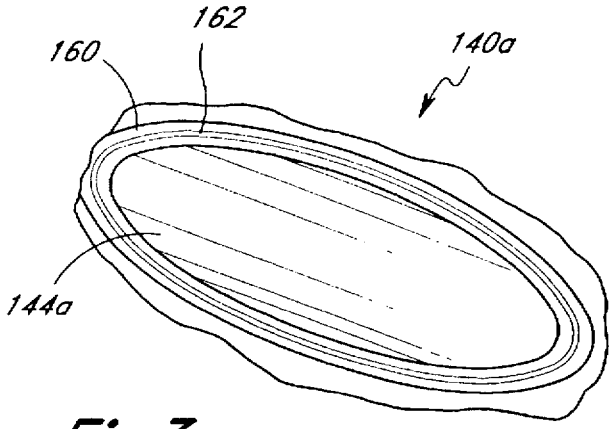
FIG. 3A is a detail of the inlet to the vacuum tubes positioned within the canister of FIG. 2.
Figure 3:
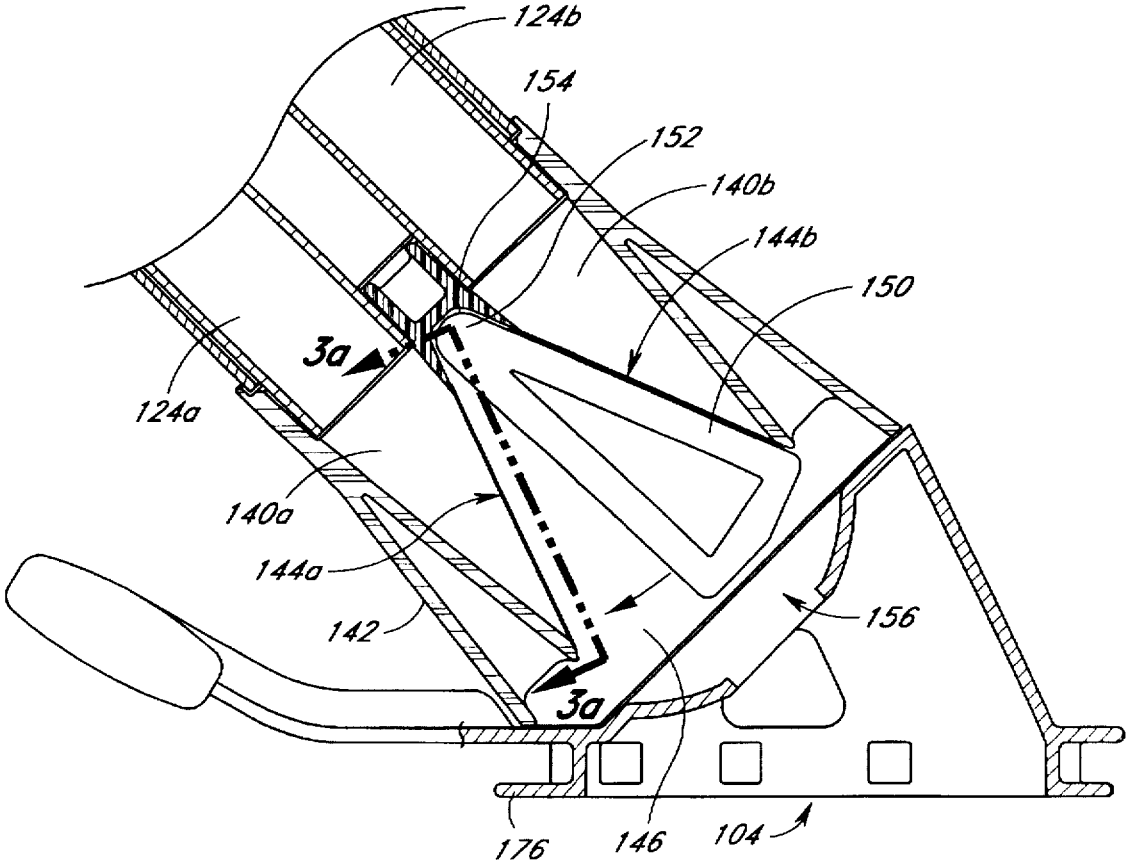
FIG. 3 is a side sectional view of the vacuum pool sweep cleaner of FIG. 1 illustrating the propulsion mechanism contained therein.

FIG. 3 illustrates inlet end 104 of the device in greater detail. In particular, the inlet end 104 of the canister 102 includes two fittings **140*a* and 140*b* that are connected to the two vacuum pipes 124*a* and 124*b* respectively. These fittings angle inward from an outer wall 142 of the device and form two elliptical openings 144*a* and 144*b*. The two fittings 140*a* and 140*b*, along with the sidewalls 122, define a generally triangular shaped plenum 146 positioned between the two elliptical openings 144*a* and 144*b*. A triangular shaped wedge 150 is positioned in the plenum 146 in such a manner so as to be able to pivot between the openings 144*a* and 144*b*. In particular, an apex 152 of the wedge 150 is captured in a cavity 154 formed between the fittings 140*a* and 140*b* so that the wedge pivots about the apex 152 in the manner illustrated in FIG. 3. The plenum 146 is in communication with the inlet orifice 104 of the device 100 via an opening 156 at the bottom of the plenum 146**.

In operation, the vacuum that is exerted by the pool filtration pump induces water to be sucked into the inlet opening 104 through the opening 156 and into the plenum 146. From the plenum 146, the water is then sucked through one or both of the vacuum pipes **124*a* and 124*b*. The suction of the water through the vacuum tubes 124***a*, 124*b* results in the wedge 150 being urged towards one of the openings 144*a* or 144*b*. The wedge 150 eventually comes in contact with the opening 144*a* and the suction in the tube 124*a* exerts a sufficient force against the wedge 150 so that the wedge 150 is sealed to the opening 144*a*. This results in mechanical movement of the pool sweep device 100 over the inner surfaces 112 of the pool. Further, the suction of the water through the intake 104 further results in the pool sweep being positioned so that the inlet pad 110 is substantially flush against the inner surface 112 of the pool in the manner shown in FIG. 1.

It will be appreciated that once the wedge 150 is sealed against the opening 144*a*, that the water will then be sucked via the opposite tube 124*b*. Over time, the suction against the wedge 150 in the opening 144*a* will be reduced as a result of the reduced water flow, and the wedge 150 will then travel to the opening 144*b* on the opposite side of the plenum 146. Eventually, the wedge 150 will become securely sealed to the opening 144*b* in the same manner as described above which will result in mechanical movement of the device 100 over the inner surfaces 112 of the pool. Hence, it will be appreciated that the device moves over the inner surfaces 112 of the pool as a result of the wedge 150 cycling between the openings 144*a* and 144*b* in response to the suction applied via the hose 107, the pipes 124*a* and 124*b*, and the openings 144*a* and 144*b*. Hence, dirt and debris can be removed from throughout the entire inner surfaces of the pool 112 as a result of the applied suction with the device 100 moving over the inner surfaces 112 in a generally random pattern.

FIG. 3A illustrates the configuration of the opening 144*a* in greater detail. In particular, the opening 144*a* is extended outward from the outer wall 142 of the canister 102. This results in the openings 144*a*, 144*b* forming a narrow lip 160. Further, in the preferred embodiment, there is a ridge 162 which extends outward from the lip 160 to further define a small area boundary for the openings 144*a* and 144*b*. The purpose of the ridge 162 is to provide an adequate seal between the opening 144*a* and 144*b* and the wedge 150. Preferably, the wedge 150 is made of a deformable material such as elastomeric plastic or rubber. When the suction urges the wedge into contact with the opening 144*a* or 144*b*, the ridge 162 is urged inward into the deformable surface of the wedge 150. This provides a very tight seal between the wedge 150 and the ridge 162 which further maximizes the mechanical force that is applied against the device 100 so as to induce the device 100 to travel over the inner surface 112 of the pool during the time period where suction is applied against the wedge prior to water fully flowing through the opposite opening and pipe. It would be appreciated that if there are leaks between the wedge 150 and the opening 144*a*, 144*b* that the mechanical force exerted on the device 100 to urge the device 100 to move over the bottom surface of the pool would be reduced.

Figure 4:
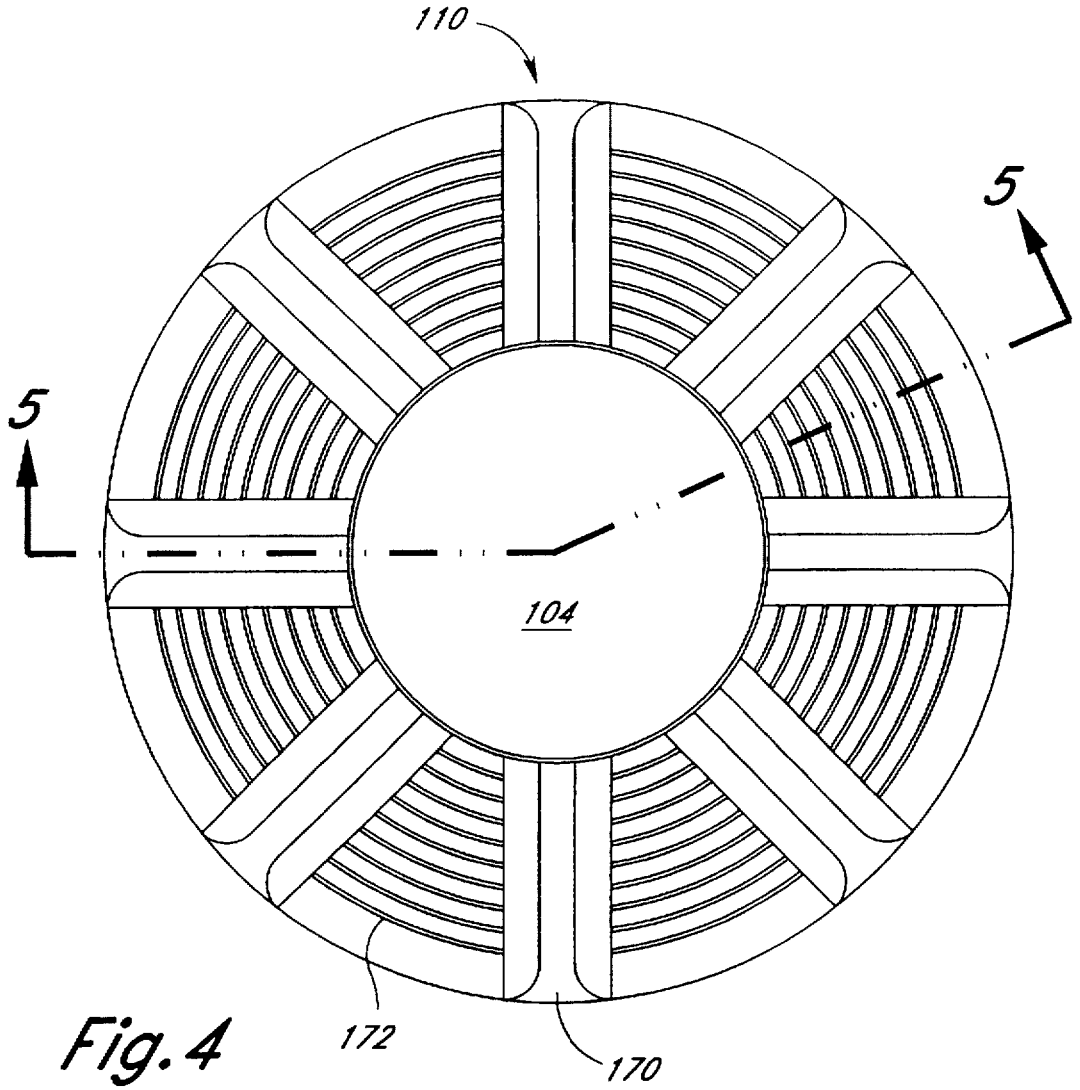
FIG. 4 is a bottom view of the intake orifice and surrounding collar of the device of FIG. 1.
Figure 5:
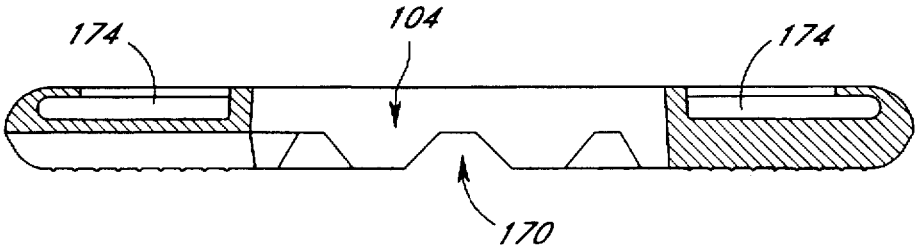
FIG. 5 is a side view of the collar and intake orifice of FIG. 4 taken along the lines 5—5 in FIG. 4.

FIGS. 4 and 5 illustrate the configuration of the inlet orifice 104 and inlet pad 110 in greater detail. In particular, the inlet pad is comprised of a rubber or plastic pad that is configured to slidably move over the inner surfaces 112 of the pool. The orifice 104 is located in the center of the pad 110 and there are a plurality of radially extending side openings 170 that allow water to flow into the orifice from an area that is positioned outside of the area underneath the pad 110. Further, the pad 110 has a plurality of circumferentially extending grooves 172 that are configured to aid in maintaining flush contact between the pad 110 and the inner surface 112 of the pool.

FIG. 5 is a side view of the pad 110 which illustrates that there are a plurality of openings 174 that are configured to receive projection 176 (FIG. 3) so that the pad 110 can be detachably mounted on the bottom end 104 of the device 100. It will be appreciated that the pad is configured to slidably move over the inner surface 112 of the pool in response to the above-described suction exerted against the wedge 150 so that particulate matter and algae can be sucked up through the central orifice into the canister 102 and then through the hose 107 to the pool's filtration system. As mentioned above, the canister is preferably made of materials and is configured so as to be light enough so that the pad 110 will preferably will sit flush with the inner surfaces 112 of the pool.

Figure 6:
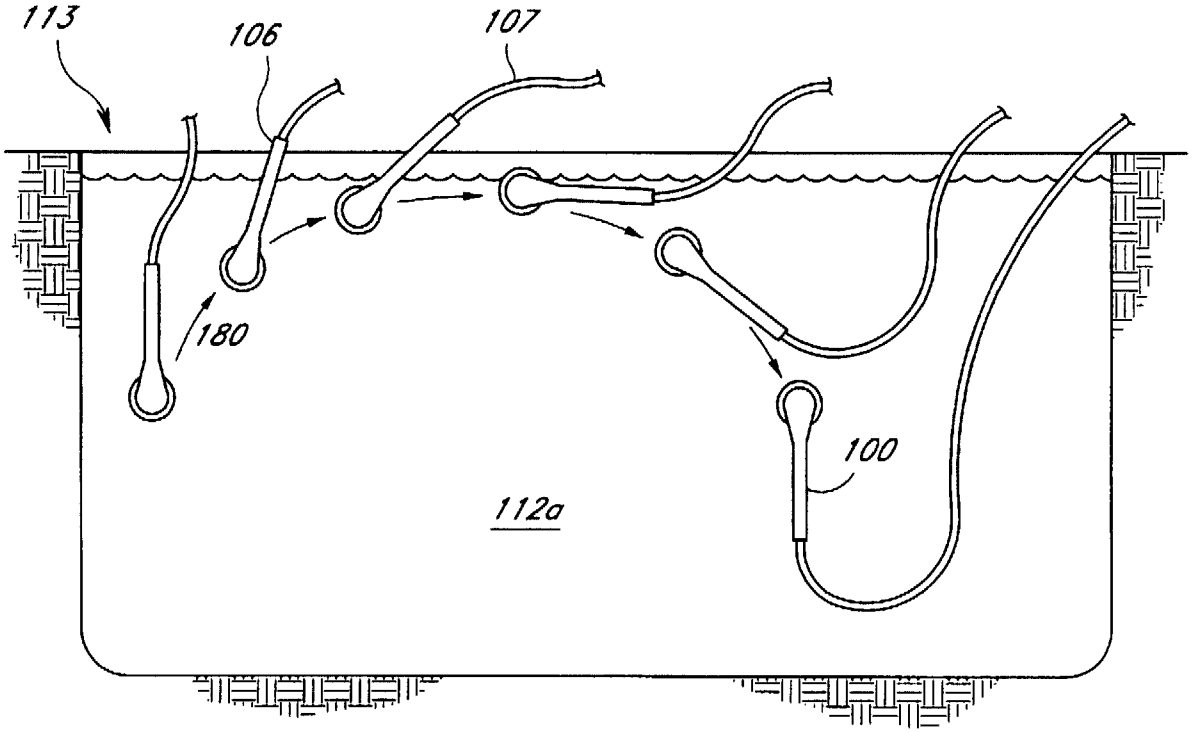
FIG. 6 is a side schematic illustrating the movement of the pool sweep cleaner of FIG. 1 as the pool sweep cleaner travels along a side wall of the pool.

FIG. 6 illustrates the operation of the device 100 as it travels over a sidewall 112*a* of a pool 113. In particular, the movement of the wedge 150 in the plenum 146 and the suction of the hose against the wedge 150 when the wedge is sealed against the lip 160 of the opening 144*a* and 144*b* results in mechanical movement in the direction of the arrows 180. Preferably, the suction exerted by the pool's filtration system through the device 100 against the sidewall 112*a* is sufficient to retain the device 100 in contact with the sidewall 112*a* as the device 100 climbs the sidewall in the directions of the arrow 180. As shown in FIG. 6, when the upper end 106 of the device extends out of the water, the device 100 preferably rotates about an axis that is centered at the center of the inlet opening 104 (FIG. 4) so that planar contact between the pad 110 and the sidewall 112*a* of the pool is substantially retained. It will be appreciated that the weight assembly 114 encourages the rotational movement of the canister in the manner shown in FIG. 6 while inhibiting the device from falling away from the sidewall 112*a* of the pool.

In this manner, the pool sweep device 100 can travel across the higher inner surfaces of the pool and thereby remove dirt, debris and algae and the like from these inner surfaces to thereby clean the pool. This device accomplishes these functions using a simple, inexpensive mechanism that does not involve a large number of moving parts. Consequently, the pool sweep device of the preferred embodiment is an inexpensive way to supply moveable suction powered pool sweep cleaner that is less inclined to break down due to the minimization of moving parts.

Although the foregoing description of the preferred embodiment of the present invention has shown, described, and pointed out the fundamental novel features of the invention, it will be understood that various omissions, substitutions, and changes in the form of the detail of the apparatus as illustrated as well as the uses thereof may be made by those skilled in the art without departing from the spirit of the present invention. Consequently, the scope of the invention should not be limited to the foregoing discussion, but should be defined by the appended claims.

What is claimed is:

1. A pool cleaning apparatus comprising:

a water intake inlet that is configured to be positioned on an inner surface of said pool while sucking water from said pool so as to suck debris from said inner surface of said pool;

two suction tubes that are configured to be attached to a single suction hose wherein said two suction tubes are in fluid communication with said water intake inlet via a plenum wherein said two suction tubes each define a first and a second opening into said plenum and wherein said first and said second openings are configured to have a lip and a raised ridge that extends around said first and said second openings; and a movable wedge having a triangular cross section defining a first and second plane that is positioned within said plenum, wherein said movable wedge is movable between a first position, wherein said first plane of said wedge covers said first opening and a second position wherein said second plane of said wedge covers said second opening so that when the first opening is covered by said wedge and said suction tubes are attached to a suction hose, a suction force is initially exerted against said wedge at the first opening inducing the apparatus to move over said inner surface of said pool and so that water flow is increased through said second opening wherein the increase in water flow over time reduces said suction force exerted at said first opening and induces said wedge to move so as to cover said second opening thereby resulting in said suction force being initially exerted against said wedge at the second opening inducing the apparatus to move over said inner surface of said pool and so that water flow is increased through said first opening wherein the increase in water flow over time reduces said suction force exerted at said second opening and induces said wedge to move so as to cover said first opening wherein said wedge is formed from a deformable material so that when said wedge covers said first or said second openings said suction force exerts a sufficient force against said deformable material so that said first and second raised ridges press into said wedge so that said raised ridges and said deformable material form a seal.

2. The apparatus of claim 1, further comprising a casing that is positioned around said first and second suction tubes and said plenum, wherein said first and second suction tubes extend inward from the inner walls of said casing so as to define said lips.

3. The apparatus of claim 1, further comprising a weight that is positioned above a plane defined by the water intake inlet wherein said weight is configured to cause the device to rotate about an axis defined by the center of the intake inlet when the apparatus extends out of the water at the side wall of the pool so that contact between the water intake and the side wall of the pool is retained.

* * * * *